United States Patent [19]

Younes

[11] Patent Number: 5,033,554

[45] Date of Patent: Jul. 23, 1991

[54] WELL POINT PLACEMENT AND REMOVAL APPARATUS

[76] Inventor: Joseph Younes, 16 Spring St., Augusta, Me. 04330

[21] Appl. No.: 563,255

[22] Filed: Aug. 6, 1990

[51] Int. Cl.[5] ..... E21B 3/02; E21B 7/26

[52] U.S. Cl. ..... 175/19; 175/121; 175/162; 175/170; 175/195; 175/203; 173/145; 173/163; 173/164

[58] Field of Search ..... 175/19, 24, 118, 121, 175/122, 162, 170, 195, 203, 323, 394; 173/56, 145, 163, 164; 74/128

[56] References Cited

U.S. PATENT DOCUMENTS

| | | | |
|---|---|---|---|
| 50,967 | 11/1865 | St. John . | |
| 64,332 | 4/1867 | Knapp et al. . | |
| 83,901 | 11/1868 | Armstrong . | |
| 92,569 | 7/1869 | Bignall . | |
| 334,919 | 1/1886 | Wickizer | 175/19 |
| 757,124 | 4/1904 | Kampfe . | |
| 1,166,153 | 12/1915 | Ridley et al. | 175/19 |
| 1,211,415 | 1/1917 | Cross . | |
| 1,398,822 | 11/1921 | Wilson . | |
| 1,639,731 | 8/1927 | Humiston . | |
| 2,662,603 | 12/1953 | Jones | 166/5 |
| 2,942,670 | 5/1958 | Burns et al. | 166/205 |
| 2,949,843 | 8/1960 | Mack | 98/57 |
| 3,087,560 | 5/1961 | Dodson | 175/314 |
| 3,181,630 | 5/1965 | Coburn | 175/122 |
| 3,399,735 | 9/1968 | Ikeda | 175/203 |
| 3,874,196 | 4/1975 | Hisey et al. | 175/195 |
| 4,176,716 | 12/1979 | Bielaczek | 166/254 |
| 4,266,444 | 5/1981 | Anderson et al. | 173/164 |
| 4,371,018 | 2/1983 | Arnold | 144/4 |
| 4,691,787 | 9/1987 | Akesaka | 173/145 |
| 4,719,978 | 1/1988 | Klemm | 175/170 |
| 4,925,159 | 5/1990 | Younes | 254/30 |

*Primary Examiner*—Bruce M. Kisliuk
*Attorney, Agent, or Firm*—Fish & Richardson

[57] ABSTRACT

A placement and removal apparatus for use in insertion and withdrawal of a well point and the like includes a vertical support column and a gripping carriage that may be moved vertically along the support column. The gripping carriage includes a carriage frame with first upper and second lower clamp assemblies vertically spaced apart and disposed on the carriage frame. Each clamp assembly may be rotated independently about a common vertical axis of rotation. Opposed jaws associated with the clamp assemblies have a well point engaging surface and may be moved to engage about a surface of a well point disposed threbetween so that the gripping carriage may apply vertical and rotational forces to the well point.

10 Claims, 13 Drawing Sheets

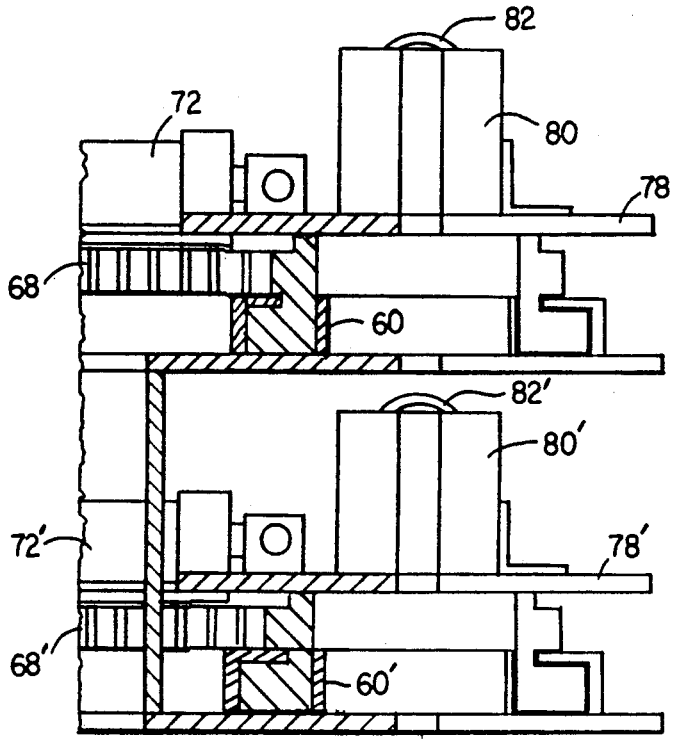
FIG. 9
FIG. 10
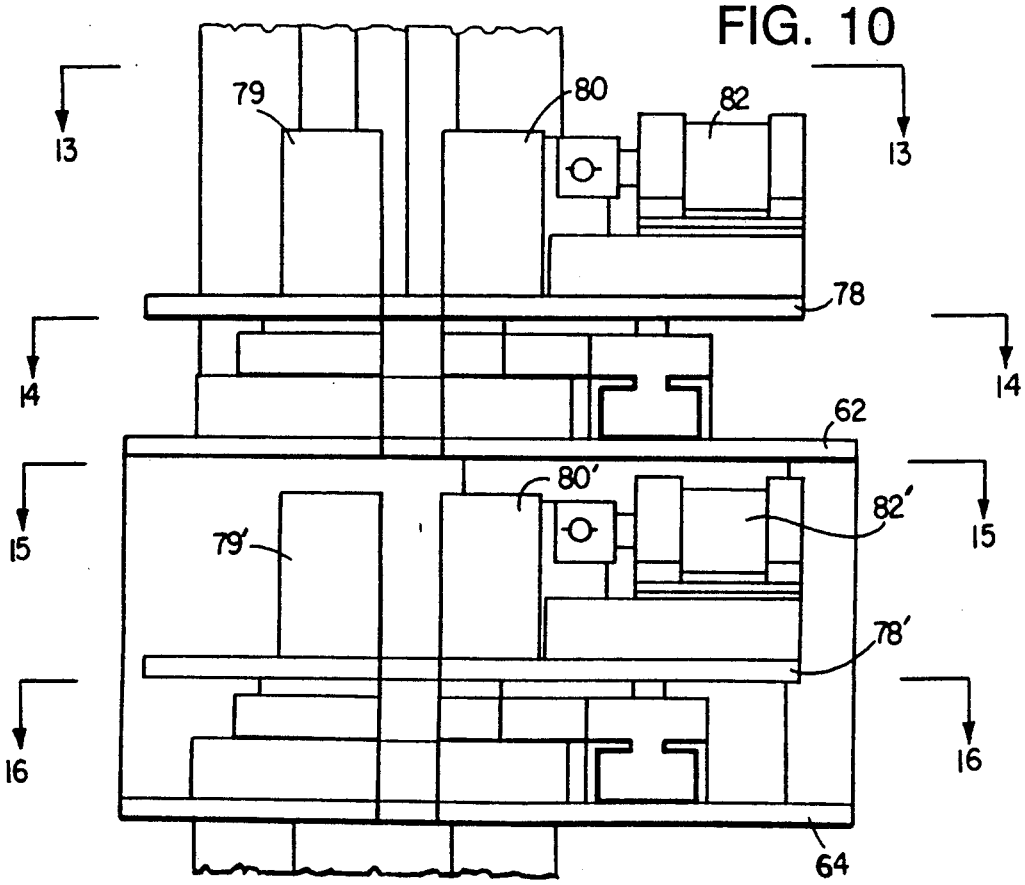

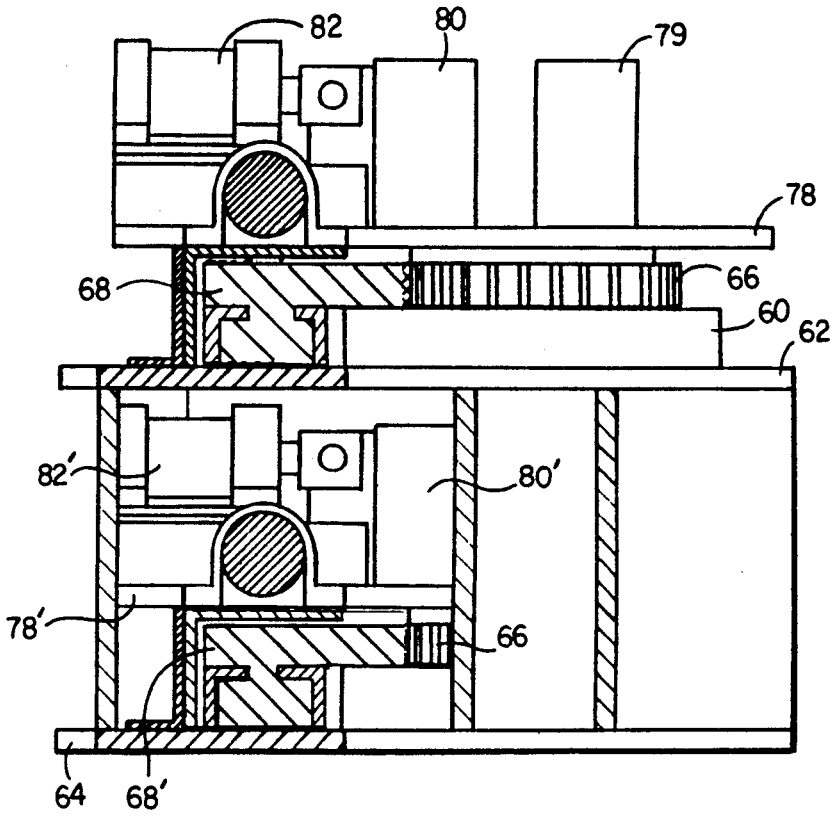
FIG. 11
FIG. 12
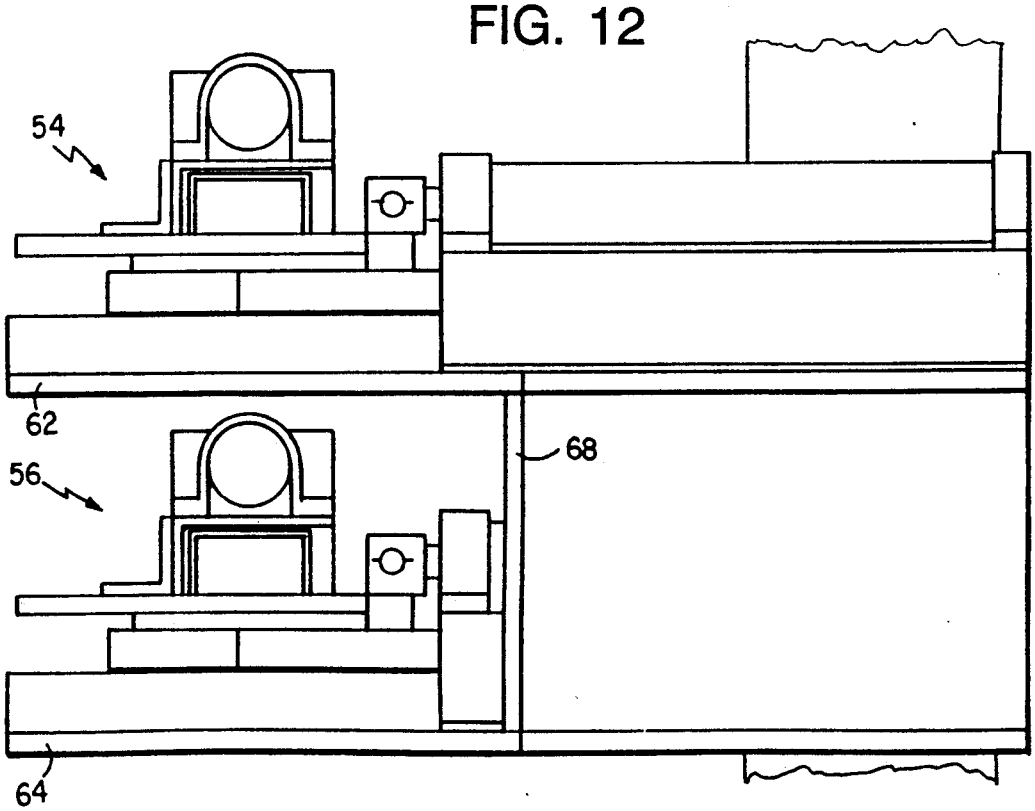

WELL POINT PLACEMENT AND REMOVAL APPARATUS

BACKGROUND OF THE INVENTION

The invention relates to power drilling and pulling devices, e.g., for vertical insertion and withdrawal of well points, posts and the like.

Well points, or well pipes, are inserted into the ground, e.g. for depths up to about 25 feet, where the water table is close to the surface. Groundwater enters a well point through perforations in a tip region, and is removed by means of a pump. One or a few well points may be used for supplying water for consumption in suitable locations. The invention is particularly addressed to well points employed in numbers, e.g., about construction sites, along the paths of underground sewer lines, concrete channels, designated building lots, excavation for laying concrete or pipelines, or anywhere it is desired to remove groundwater to temporarily lower the water table to permit excavation and installation of pipes or equipment. When the need has ended, e.g., upon completion of a project, the well points are removed from the ground for use at the next site. In order to avoid the pipes becoming jammed in the ground, it is important that force be applied to the well point axially, i.e. vertically in the usual situation, as it is withdrawn. Also, it is advantageous to be able to pull more than one well point without having to move the entire pulling apparatus each time to another location.

SUMMARY OF THE INVENTION

According to the invention, a placement and removal apparatus for use in insertion and withdrawal of a well point and the like comprises a vertical support column, a gripping carriage adapted to move vertically along the support column, and means for moving the carriage vertically along the column. The gripping carriage comprises a carriage frame; a first upper clamp assembly and a second, vertically spaced apart lower clamp assembly disposed on the carriage frame, each clamp assembly adapted to rotate independently about a common vertical axis of rotation; and means for rotating each clamp assembly independently about the axis of rotation. Each clamp assembly further comprises opposed jaw elements defining a well point-engaging surface and actuating means for causing the well point-engaging surface of the opposed jaw elements to engage about a surface of a well point disposed therebetween, whereby the gripping carriage is adapted to apply vertical and rotational forces to the well point.

Preferred embodiments of the invention may include one or more of the following features. The vertical support column comprises an outer column member and an inner column member disposed coaxially therewithin, the inner column member adapted for movement axially relative to the outer column member. Preferably the vertical support column further comprises means for adjusting the relative axial positions of the outer column member and the inner column member. The means for rotating each clamp assembly independently about the axis of rotation comprises means for actuation, a driving element and a rotatable element. Preferably the means for actuation comprises a hydraulic cylinder. More preferably the driving element is connected to the cylinder and is adapted for linear driving motion, and the driving element is disposed in engagement with the rotatable element. The rotatable element may be a gear with the driving element defining a plurality of teeth in engagement with teeth of the gear. Each clamp assembly is adapted to rotate independently about a common vertical axis of rotation in both a first direction and in a second direction. The opposed jaw elements comprise a fixed jaw member and a moveable jaw member, and the actuating means is adapted to move the moveable jaw toward the fixed jaw. The placement and removal apparatus of the invention further comprises a well point having an elongated body with a first lower end and a second upper end, the body defining a central cavity and perforations extending through a wall of the body for flow of water into the cavity, a collar defined adjacent the upper end, and external helical threads defined at least adjacent the lower end.

These and other features and advantages of the invention will be seen from the following description of a presently preferred embodiment, and from the claims.

DESCRIPTION OF A PRESENTLY PREFERRED EMBODIMENT

We first briefly describe the drawings.

FIG. 4A is a side plan view of a well point of the invention while

Figure 5A:
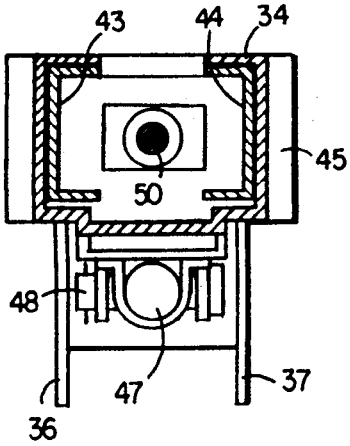
FIG. 5A is a top sectional view of the column support taken along the line 5A—5A of FIG. 5.
Figure 5B:
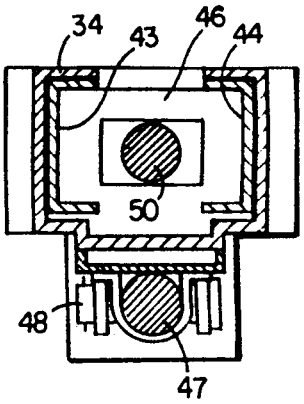
FIG. 5B is a top sectional view of the column support taken along the line 5B—5B of FIG. 5.
Figure 5:
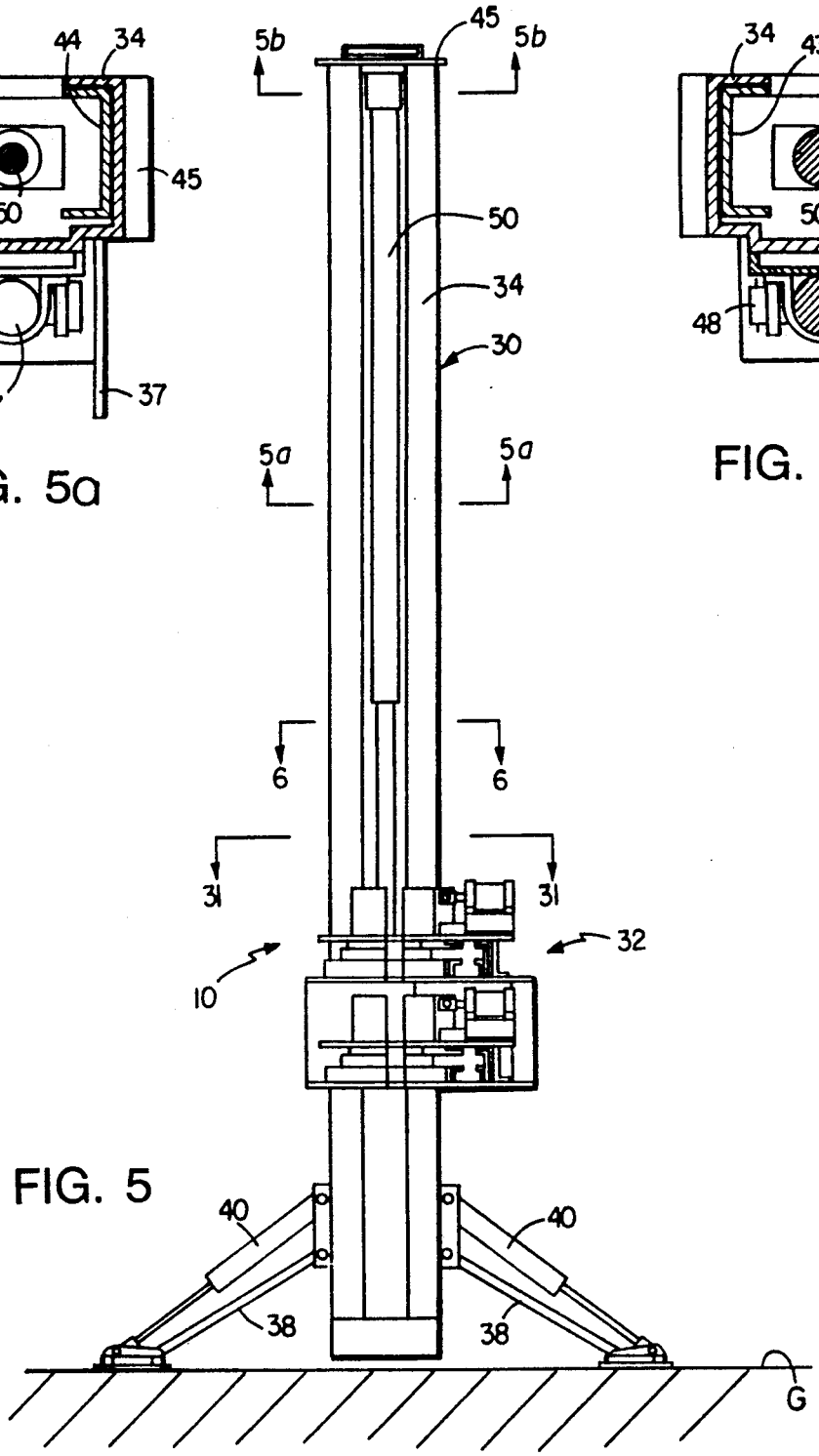
FIG. 5 is a front view of the end portion of the drilling/pulling apparatus of FIG. 1.
Figure 6:
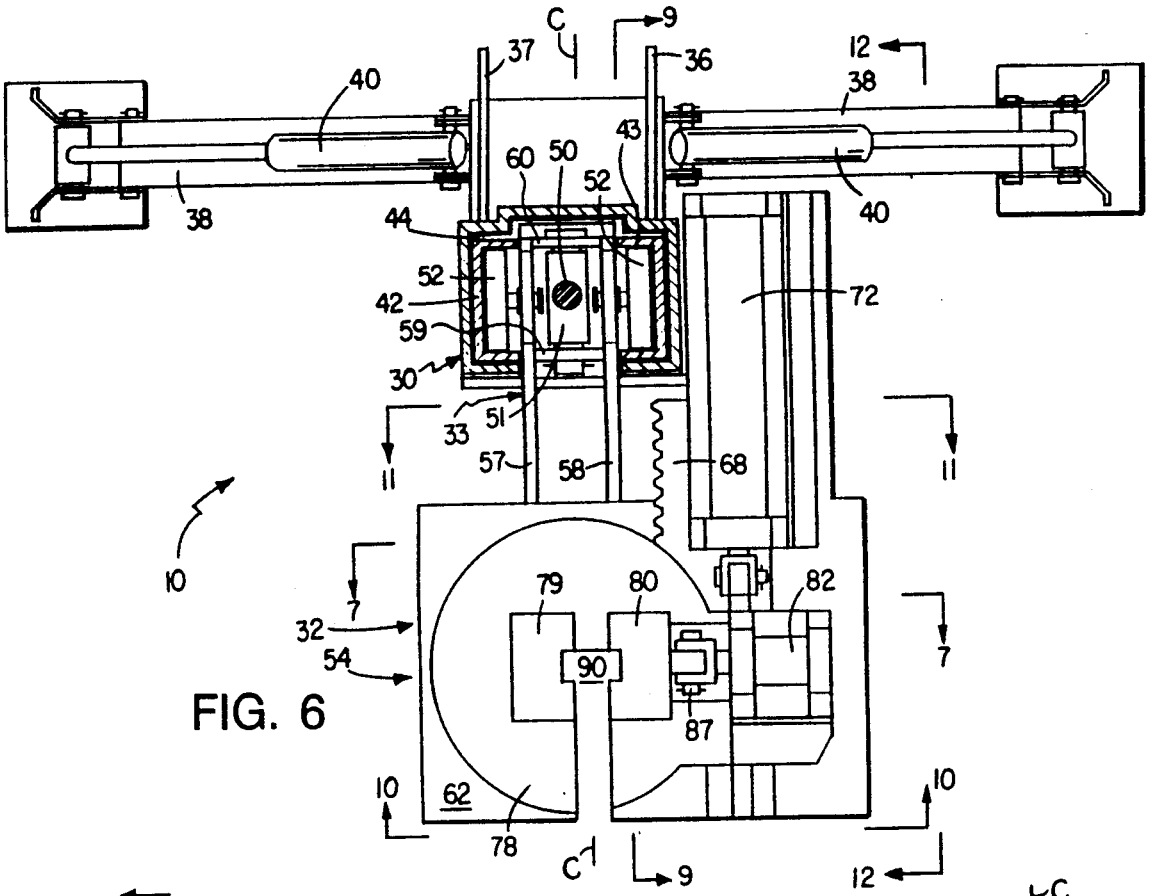
FIG. 6 is a plan view of the gripping carriage taken along the line 6—6 of FIG. 5.
Figure 17:
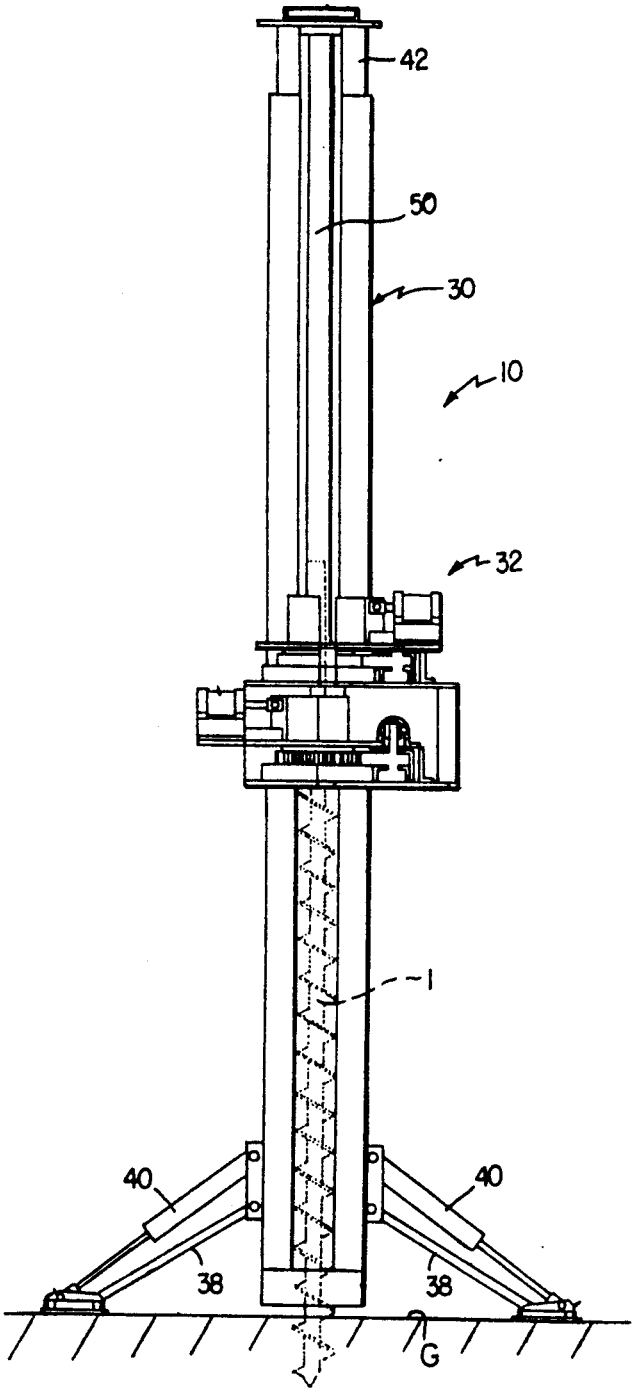
Figure 18:
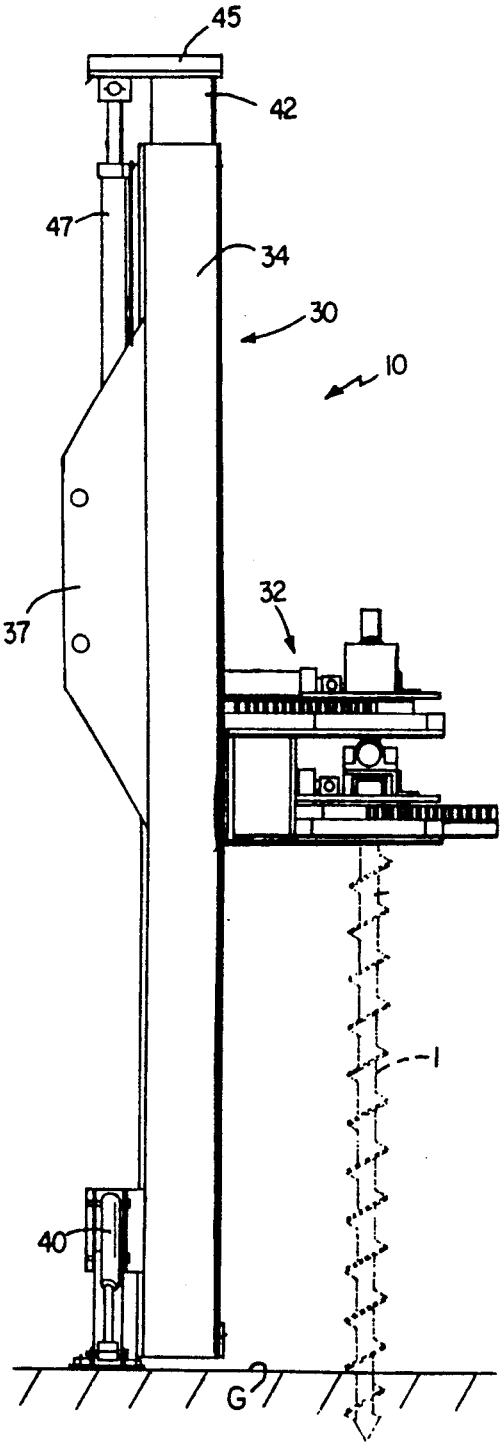
Figure 19:
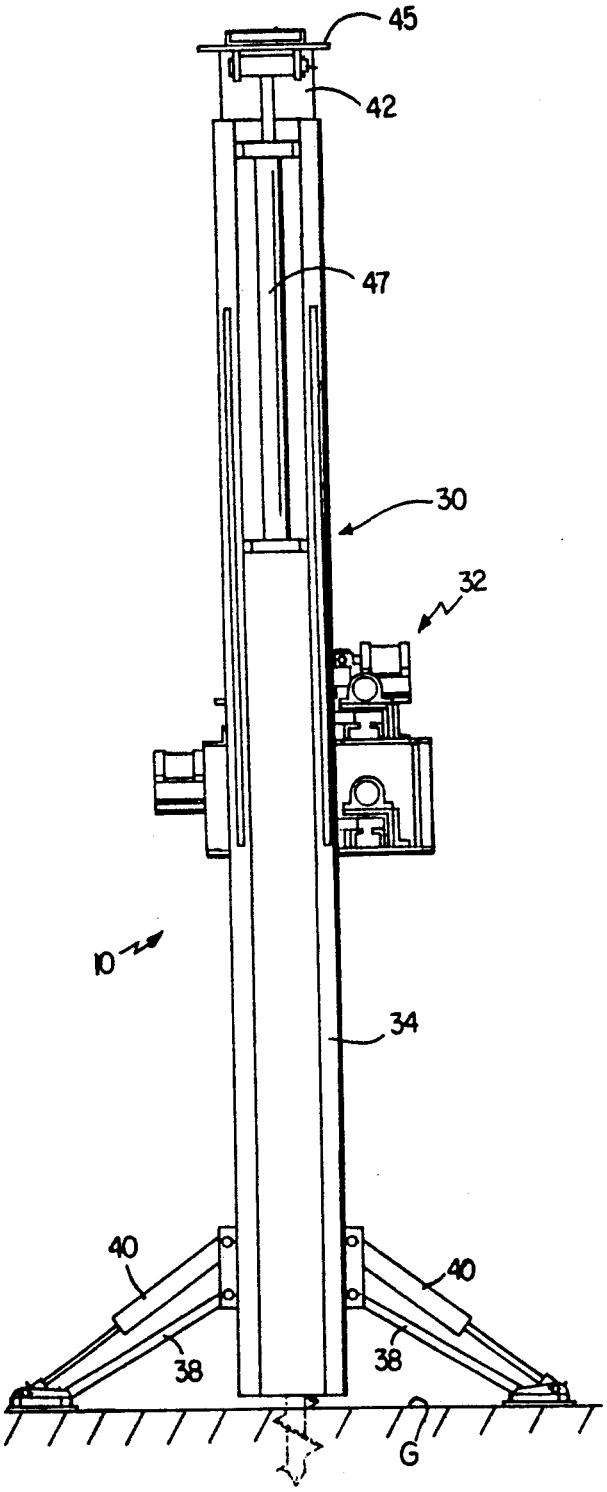
Figure 20:
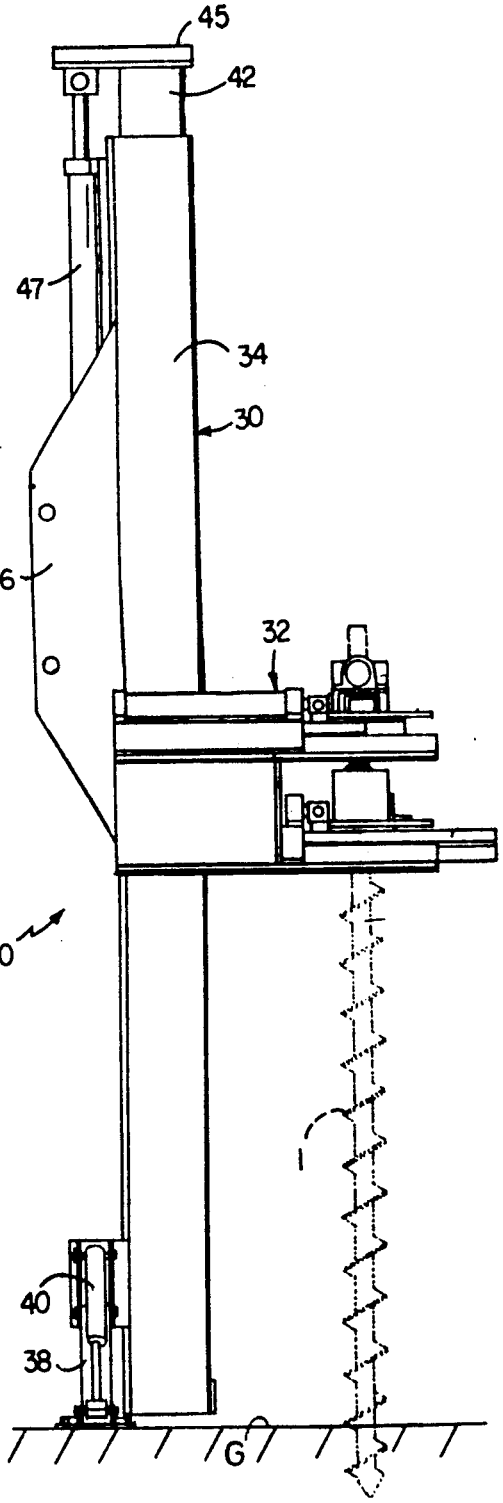
Figure 21:
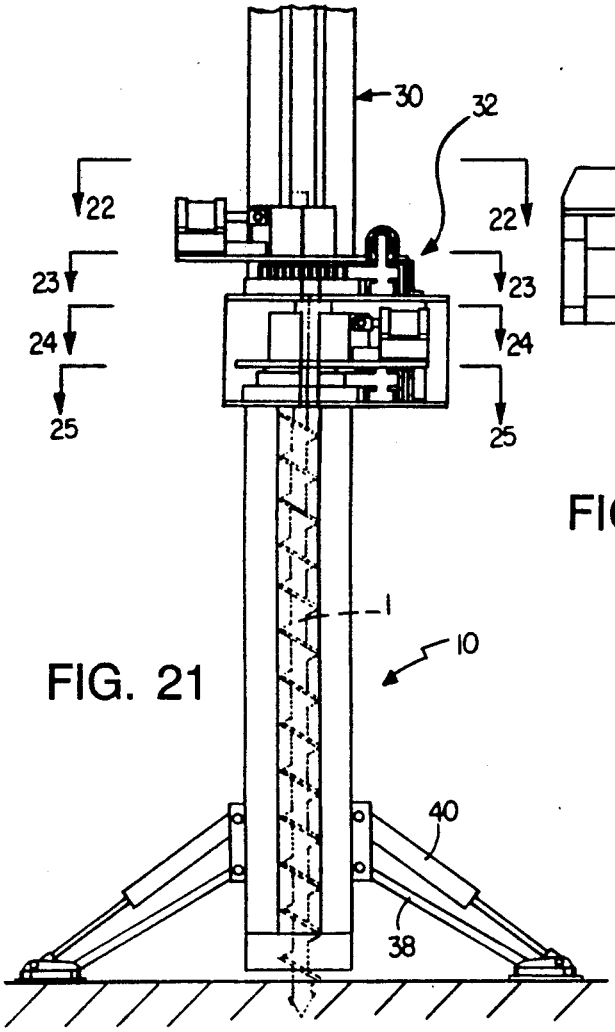
Figure 22:
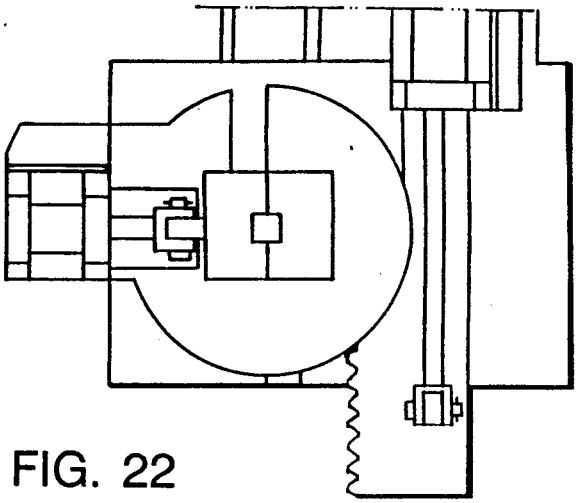
Figure 23:
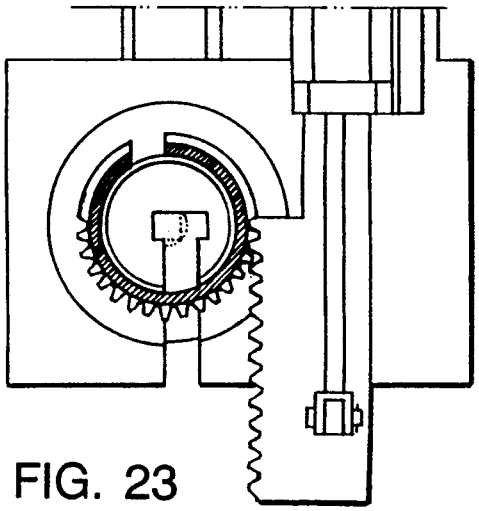
Figure 24:
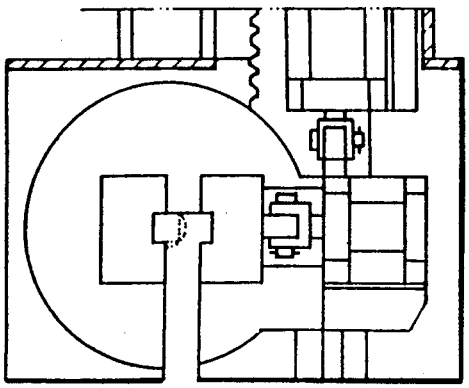
Figure 25:
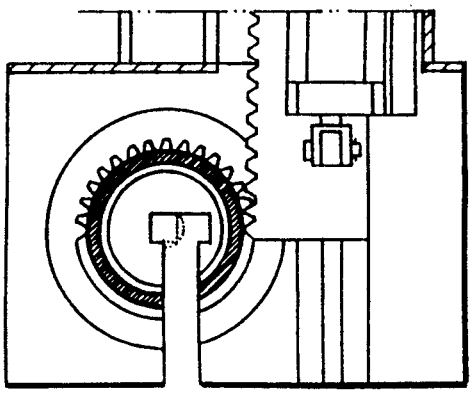
Figure 26:
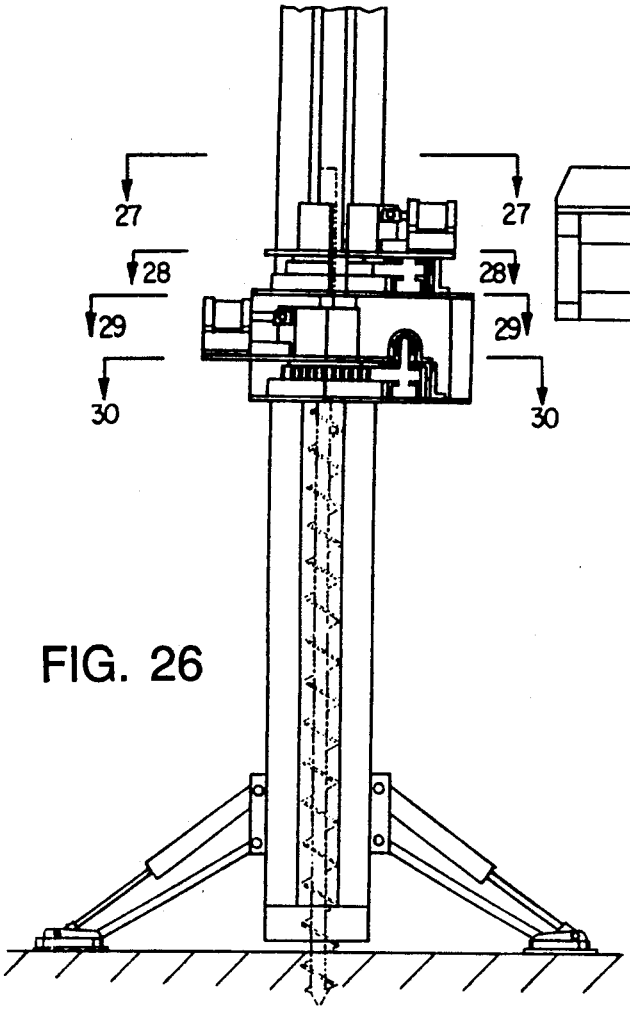
Figure 29:
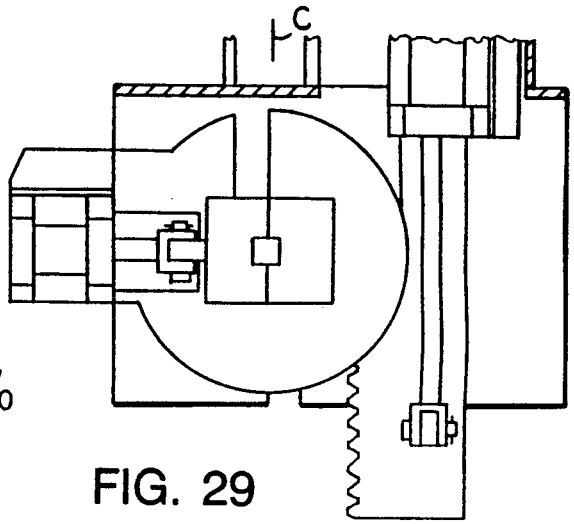
Figure 30:
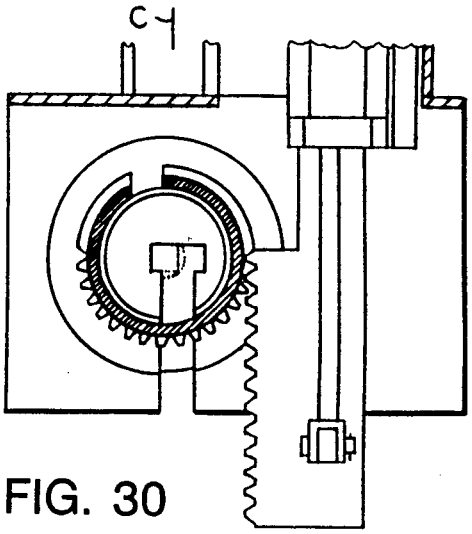
Figure 27:
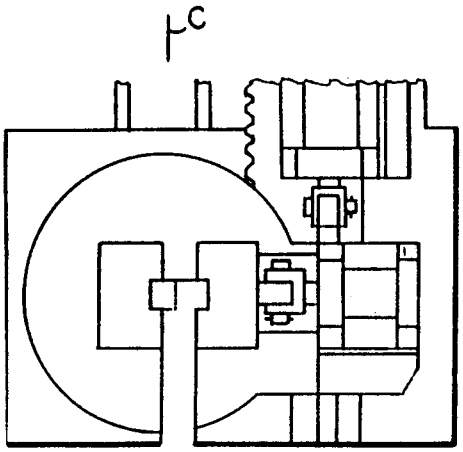
Figure 28:
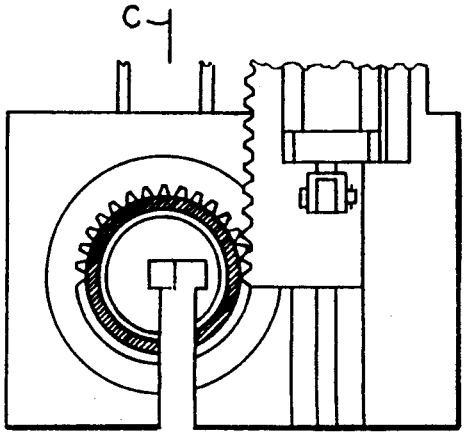
Figure 32:
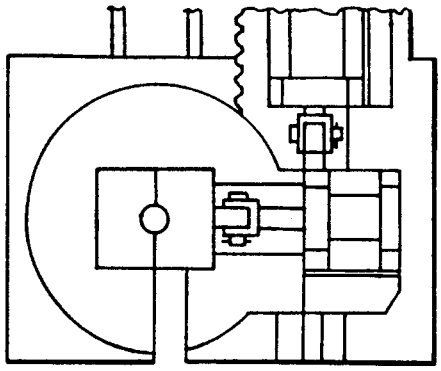
Figure 33:
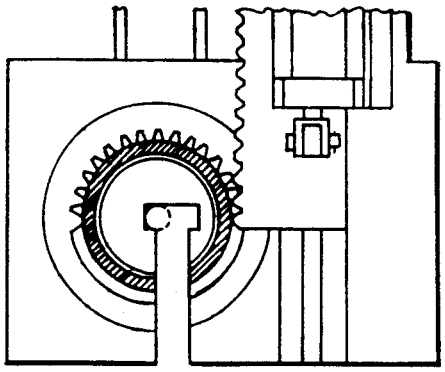
Figure 34:
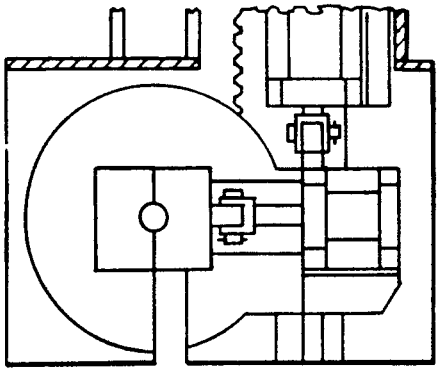
Figure 35:
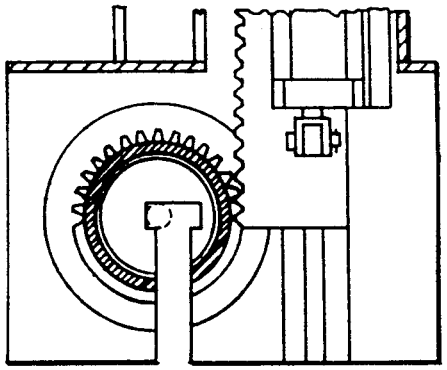
Figure 31:
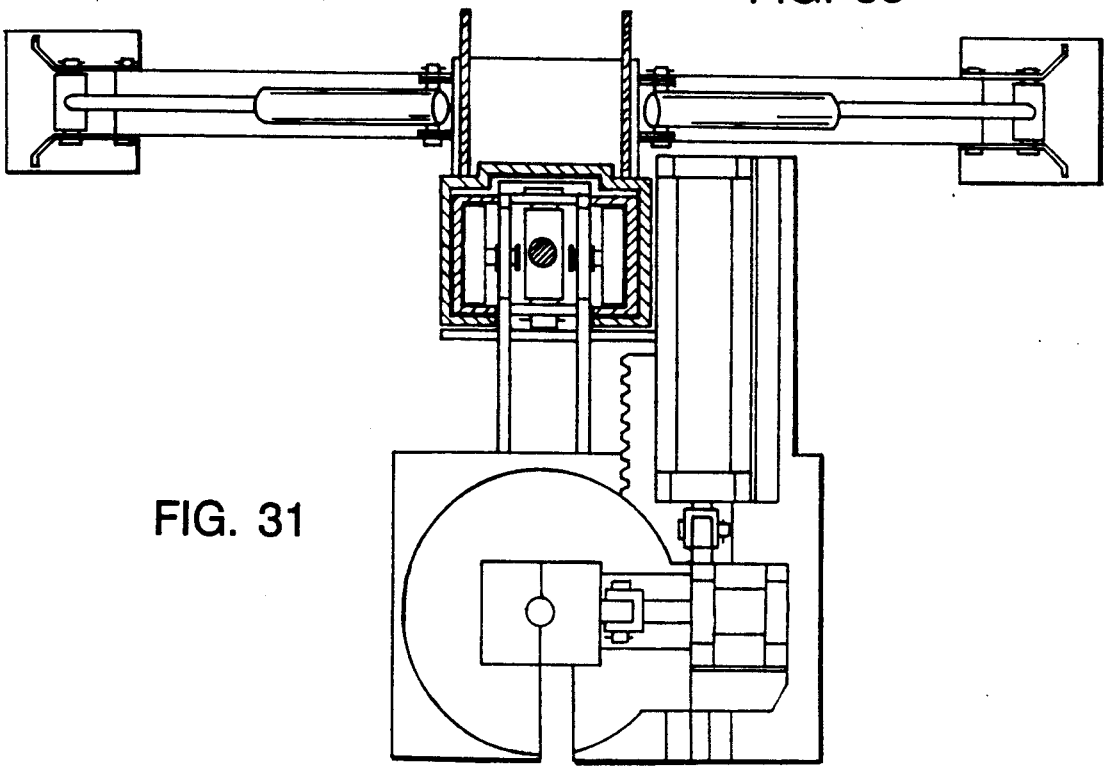

FIG. 9 a side section view taken along the line 9—9 of FIG. 6;

FIG. 10 is a front view of the gripping carriage of the drilling apparatus of FIG. 6;

FIG. 11 is a partial rear section view of the gripping carri taken along line 11—11 of the FIG. 6;

FIG. 12 is a side view of the gripping carriage of the apparatus of FIG. 6;

FIGS. 13, 14, 15 and 16 are bottom section views of the gripping carriage of FIG. 10;

FIGS. 17 and 18 are front and side views, respectively, of the drilling/pulling apparatus of the invention inserting a well point into the ground;

FIGS. 19 and 20 are front and side views, respectively, of the drilling/pulling apparatus inserting a well point into the ground;

FIG. 21 is a front view of the drilling/pulling apparatus during a cycle during operation;

FIGS. 22, 23, 24 and 25 are bottom section views taken respectively along lines 22—22, 23—23, 24—24 and 25—25 of FIG. 21;

FIG. 26 is a front view of the drilling/pulling apparatus during in a subsequent cycle during operation;

FIG. 27, 28, 29 and 30 are bottom section views of the gripping carriage taken respectively along lines 27—27, 28—28, 29—29 and 30—30 of FIG. 26;

FIG. 31 is a top section view of the drilling/pulling apparatus taken along line 31—31 of FIG. 5; and FIGS. 32, 33, 34 and 35 are bottom section views of an alternative gripping carriage of the invention.

Referring to FIGS. 1, 2, 3 and 5, the power well point placement and removal apparatus 10 of the invention is mounted upon a commercially available tractor unit 12 (e.g., commercially available as the Caterpillar 212 Excavator). The placement and removal apparatus 10 is constructed to insert a well point 1 (FIG. 4A) into the ground and to subsequently remove the well point when use is complete. The tractor unit 12 is mounted upon a chassis 13 with wheels 14 and is adapted for rotation upon hydraulic slewing ring 16 A pair of outriggers 18 serve to stabilize the tractor during operation of the well point drilling apparatus 10. The tractor unit 12 has a fore-boom 20 mounted at the end of a stub-boom 22. A hydraulic cylinder 26 provides means for adjustment of the orientation of the drilling apparatus 10 relative to the fore-boom 20. The stub-boom 22 is positioned by hydraulic cylinder 28 which, together with the hydraulic cylinder 26, positions the drilling-/pulling apparatus 10 at the desired orientation and ensures that any force is applied coaxially to the well point 1 to avoid damage from bending. The drilling-/pulling apparatus 10 is pivotally mounted at the end of the fore-boom 20 upon a pivot pin 24. In general, a well point 1 is to be positioned perpendicular to the ground G, although the hydraulic cylinders 26 and 28 may be positioned in a manner to make it possible to insert a well point into ground at other angles. The hydraulic power system of the tractor unit 12 also provides the power necessary for operation of the various hydraulic cylinders of the drilling/pulling apparatus 10, as described in more detail below.

Figure 4A:
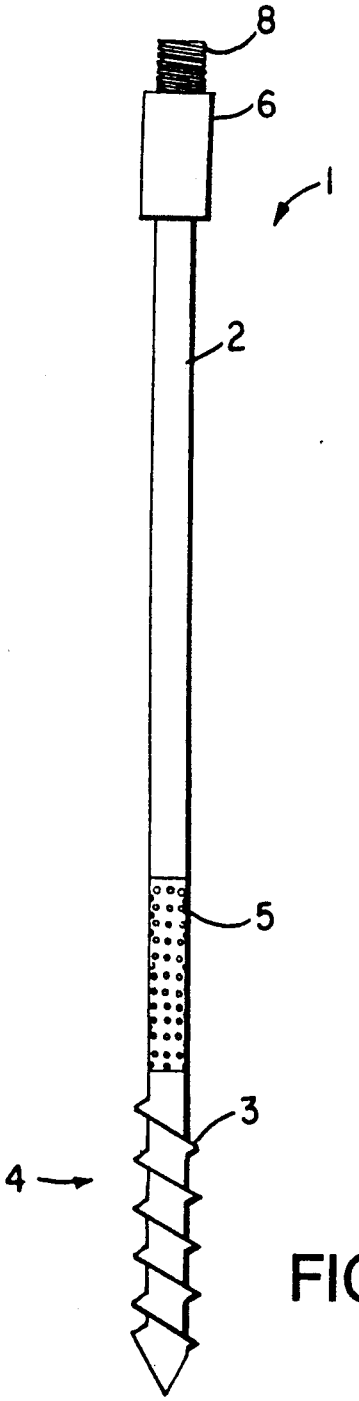
Figure 4B:
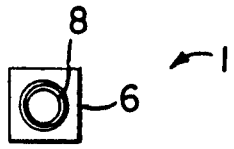
FIG. 4B is a top plan view of the well point FIG. 4A.

An exemplary well point for use in conjunction with the drilling device 10 of the invention is described in reference to FIGS. 4A and 4B. The well point 1 has an elongated cylindrical body 2 with threads 3 defined about its outer surface in the region of the tip 4. Perforations 5 are defined by the cylindrical body in a region adjacent the tip region 4 to allow water to flow into a central axial bore or cavity defined by the cylindrical body. To remove water from the central bore cavity of the well point, a pump (not shown) may be connected to a threaded portion 8 of the well point i. In the embodiment shown, the well point 1 has a rectangular collar 6 in the upper region adjacent threads 8 which may be gripped by the drilling/pulling apparatus 10 of the invention for rotation of the well point during insertion and withdrawal, as described below. The threaded tip region 4 of the well point facilitates placement and, in particular, removal of the well point from the ground.

Figure 1:
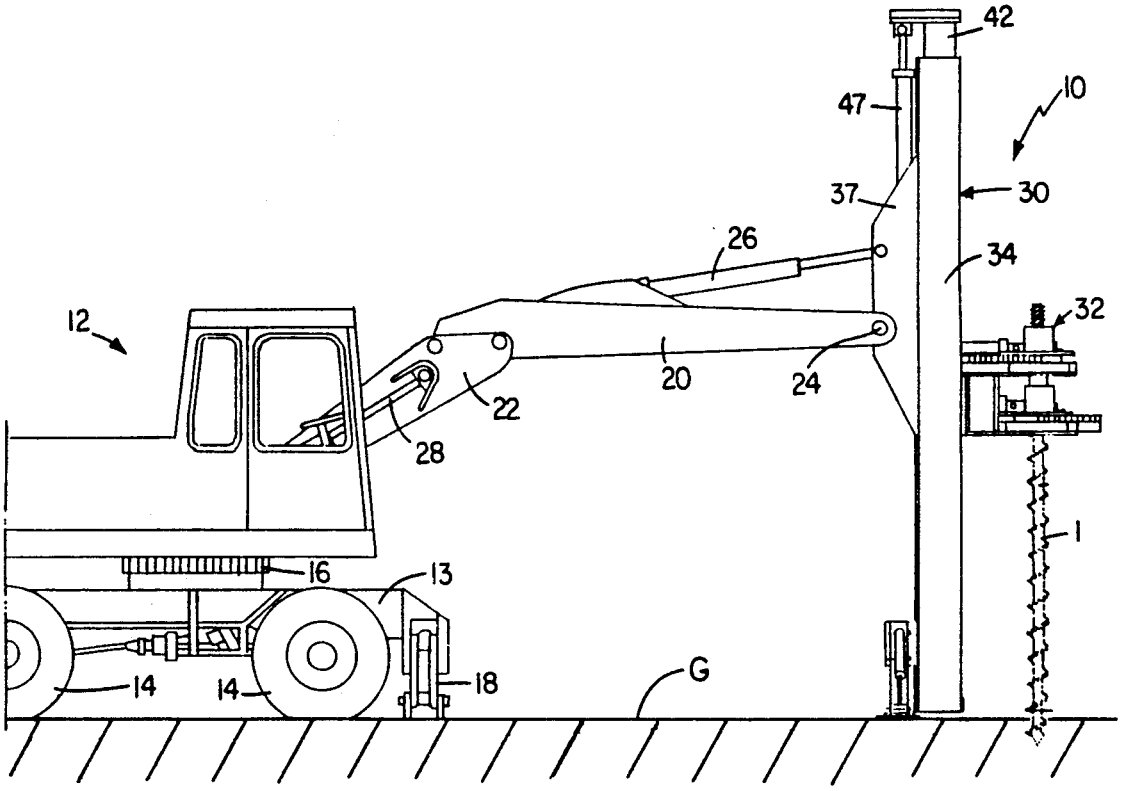
FIG. 1 is a side view of a tractor unit equipped with one embodiment of a drilling/pulling apparatus of the invention.
Figure 2:
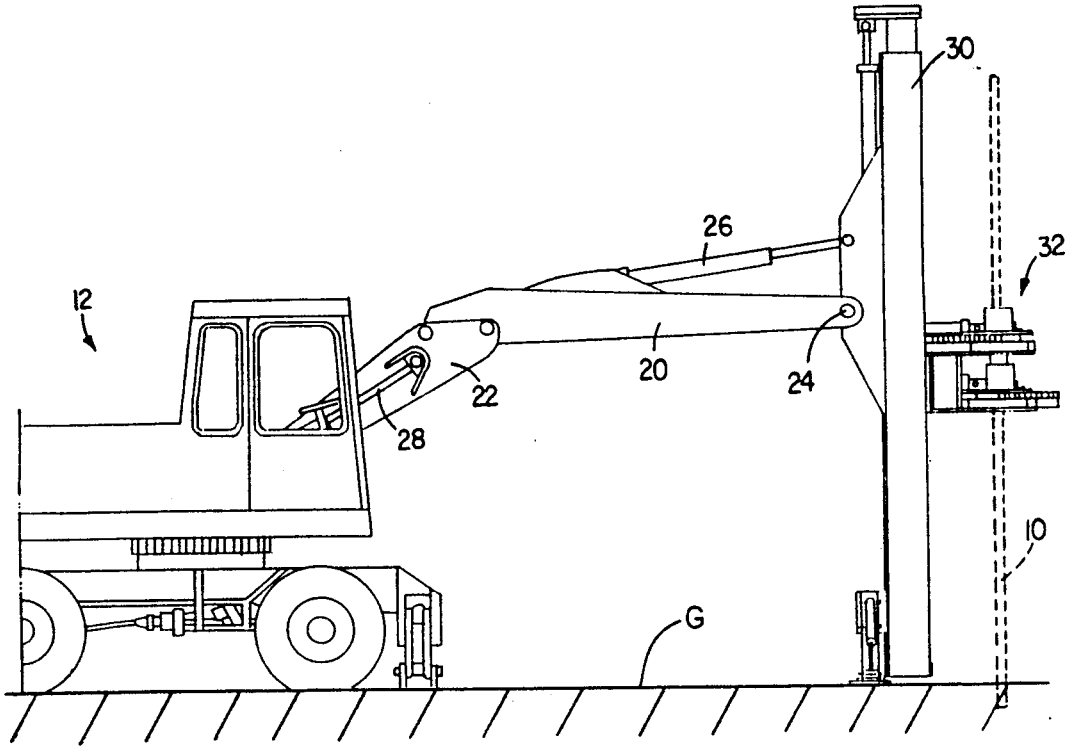
FIGS. 2 and 3 are sequential side views of the tractor and mounted drilling/pulling apparatus FIG. 1 being positioned.
Figure 3:
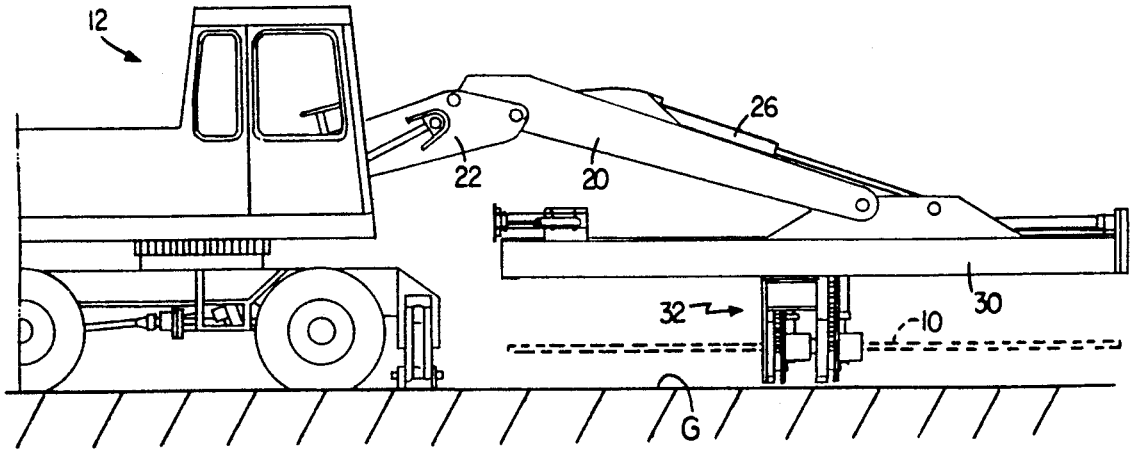

Referring now to FIGS. 1, 2 and 3, the well point drilling/pulling apparatus 10 consists of support column upon which is mounted a well point gripping carriage 32 adapted for vertical movement along the support column. The gripping carriage 32 is constructed to grasp the collar 6 of well point 1 and impart a rotational force thereto, as described in more detail below. Referring now also to FIGS. 5, 5A and 5B, the support column 30 includes an outer casing 34. A pair of mounting members 36, 37 extend from the rear surface of the support column for attachment of the drilling/pulling apparatus upon the tractor fore-boom 20 and for attachment of the hydraulic cylinder 26. Outriggers 38 and the associated hydraulic cylinders 40 extend from attachment at the lower portion of the support column 30 to engage the ground surface G in a manner to orient and stabilize the drilling/pulling apparatus 10 during operation. The support column 30 further includes an inner column member 42 (FIG. 1) adapted for axial movement relative to the outer casing 34. The inner column member consists of a pair of U-shaped inner column elements 43, 44, and a top support plate 45 and a bottom support plate 46 attached thereto. A vertical extension hydraulic cylinder for axial adjustment of the position of the inner column member 42 relative to the outer casing 34 extends between the undersurface of the upper support plate 45 and attachment to the mounting members 36, 37 at the rear of the support column 30 by a pin 48. Adjustment of the axial position of the inner column member 42 permits adjustment of the length of the column upon which the gripping carriage 32 may travel between a greater length (FIGS. 1 and 2), with the inner column member 42 extended for placement or withdrawal of extended lengths of well point, and a shorter length (FIG. 3), with the inner column member 42 retracted, e.g. for lower clearance during movement of the tractor under bridges, power lines and other overhead obstructions.

Referring now to FIGS. 5 and 6, hydraulic cylinder 50 is disposed vertically within the bore of the inner column member 42 and engages the gripping carriage 32 in a manner to raise or lower the carriage relative to the support column 30 while applying force necessary for insertion or removal of a well point 1 into or out of the ground G. Hydraulic cylinder 50 is attached at its upper end to the upper support plate 45. At its lower end, cylinder 50 is attached to gripping carriage 32 by pin 51. The gripping carriage 32 is moved vertically along the support column 32 in response to actuation of the cylinder 50, riding upon bearings 52 within the inner column member 42.

Figure 7:
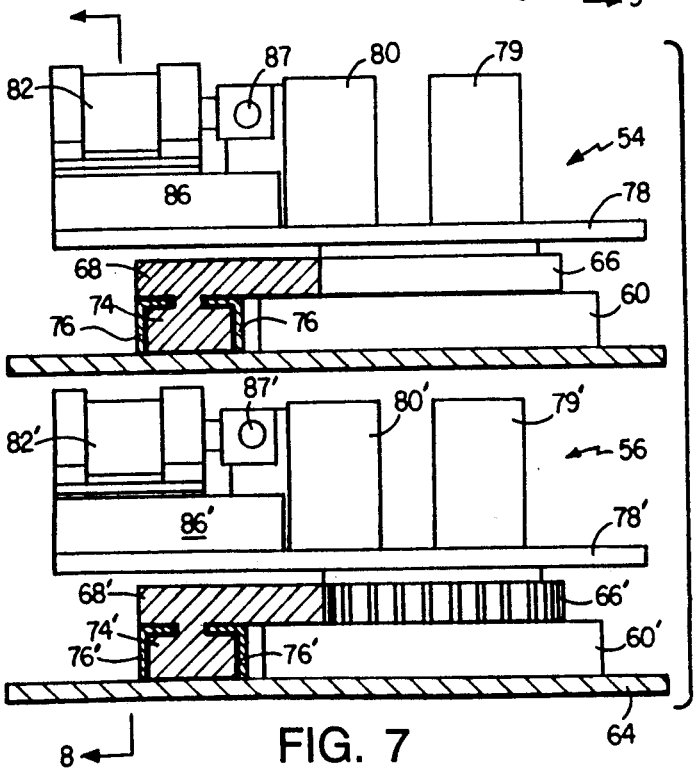
FIG. 7 is a rear section view of the gripping carriage taken along the line 7—7 of FIG. 6.
Figure 8:
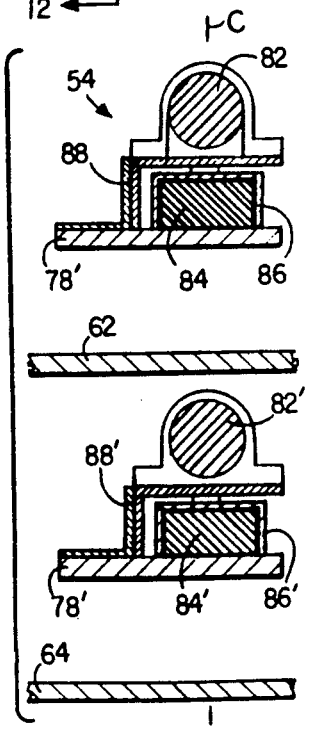
FIG. 8 is a partial section view of the moveable drilling/pulling apparatus taken along the line 8—8 of FIG. 7.
Figure 13:
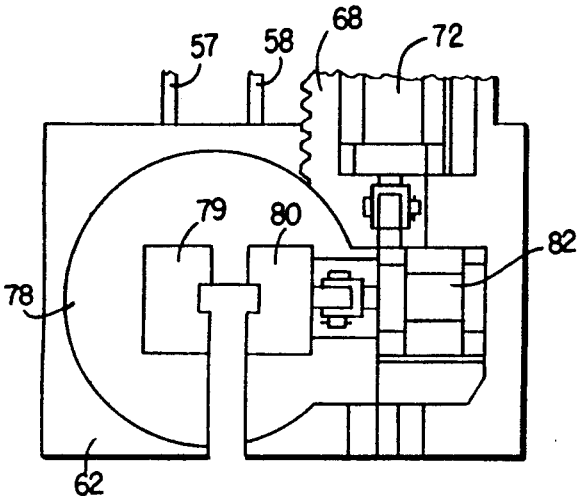
Figure 14:
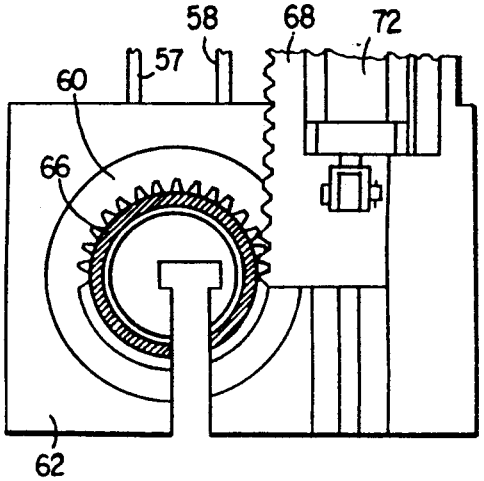
Figure 15:
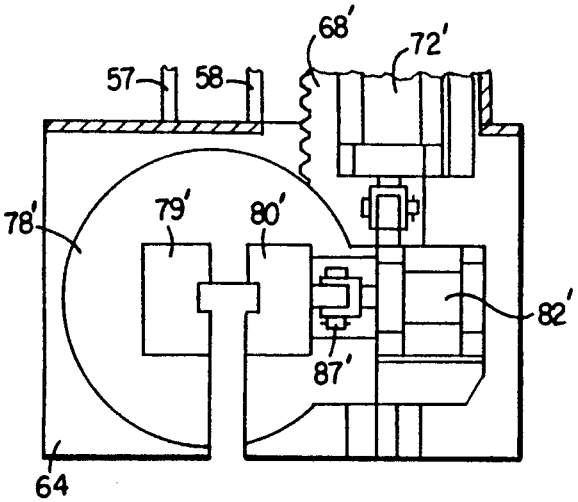
Figure 16:
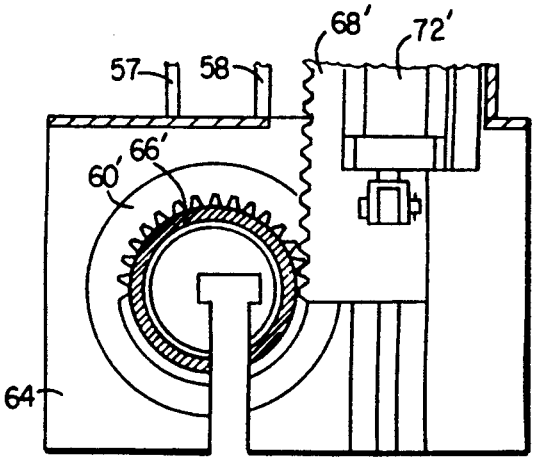

The gripping carriage 32 includes an upper rotating clamp assembly 54 and a lower rotating clamp assembly 56 which are actuated a synchronously to apply torque to the well point 1. A gripping carriage support frame 33 is formed by four vertically oriented steel plates 57, 58, 59 and 60 (FIG. 6). Plates 57, 58 extend from within the support column where the bearings 52 are mounted thereupon. Spaced apart plates 59, 60, which are attached at right angle between plates 57, 58, accommodate pin 51 attaching the vertical hydraulic cylinder 50 to the gripping carriage 32. Rotating clamp assemblies 54, 56 are mounted upon horizontal support plates 62, 64 (FIGS. 7, 8), which in turn are mounted upon the outer arm extensions of plates 57, 58. Finally, the support frame further includes a vertical support plate 66 disposed between horizontal support plates 62, 64 (FIG. 11) to reinforce the support frame 33.

When the vertical cylinder 50 is actuated for vertical movement within the support column 30, the horizontal support plates 62, 64 are raised and lowered along with the rotating clamp assemblies 54, 56 of the gripping carriage 32 mounted thereupon.

Referring now to FIGS. 6–12, the gripping carriage 32 includes upper and lower rotating clamp assemblies 54, 56. The upper clamp assembly 54 and the lower clamp assembly 56 are essentially the same in structure and function and, for ease of understanding, identical elements described with respect to the upper clamp assembly will be given the same reference number in the lower clamp assembly marked with a prime (′). The rotating clamp assemblies 54, 56 are constructed to separately grip the collar 6 of the well point 1 for application of rotational torque. Sleeves 60, 60′ are mounted upon plates 62, 64, and rotatable gear members 66, 66′ are mounted for rotation thereupon. Linear driving members 68, 68′ are disposed upon the horizontal support plates 62, 64 and have teeth configured and arranged to mesh with the teeth of gear members 66, 66′. The driving members are actuated for oscillating motion by hydraulic cylinders 72, 72′ (only one may be seen in FIG. 6) mounted between the driving members 66, 66′ and the support plates 62, 64. The driving members 68, 68′ include guiding portions 74, 74′ which move axially within conduits defined by opposed pairs of angle members 76, 76′ mounted upon plates 62, 64. By interengagement of the teeth of the driving members 68, 68′ and the gear members 66, 66′, extension of hydraulic cylinders 72, 72′ causes linear driving members 68, 68′ to rotate gear members 66, 66′ on sleeves 60, 60′ to the positions shown in FIGS. 22, 23. When the hydraulic cylinders 72, 72′ are retracted in return strokes, the rotating clamp assemblies are returned to their original positions.

Clamp mounting plates 78, 78′ are attached to the ′ upper surfaces of the rotating gear members 66, 66′ and support opposed pairs of fixed and moveable jaw members 79, 80 and 79′ , 80′, and hydraulic cylinders 82, 82′. As shown, the mounting plates 78, 78′, the opposed jaws 79, 80 and 79′, 80′ and the jaw actuation hydraulic cylinders 82, 82′ are disposed to rotate with the rotating gears 66, 66′. The jaw members 79, 79′ and 80, 80′ consist of rectangular blocks having inner surfaces of size and shape to receive and grip the collar 6 of the well point 1. Fixed jaw members 79, 79′ are fixedly mounted upon plates 78, 78′, while the moveable jaw members 80, 80′ are attached to guiding members 84, 84′ received for axial sliding movement within the conduits defined by channel members 86, 86′The hydraulic cylinders 82, 82′ are attached to the guiding members 84, 84′ by pins 87, 87′, and are mounted on supports 88, 88′ mounted upon plates 78, 78′. The hydraulic cylinders 82, 82′ are actuated to move the jaw members 80, 80′ towards fixed jaw members 79, 79′ for gripping engagement of the collar 6 of a well point 1 therebetween.

Referring to FIGS. 21 through 30, use of the drilling-/pulling apparatus of the invention will now be described.

After the tractor unit 12 has been moved into position and the outriggers 18 are engaged, the stub-boom 22 and fore-boom 20 are extended and the power well point drilling/pulling apparatus 10 of the invention is disposed in the desired orientation, e.g. vertical. A well point 1, e.g. as shown in FIGS. 4A and 4B, and as described above, is positioned for insertion into the ground at the desired angle.

The hydraulic extension cylinder 47 is actuated if necessary to adjust the position of the inner column member 42 relative to the support column 30. The position of the gripping carriage 32 along the support column 30 is then adjusted by actuation of hydraulic cylinder 50 to place the collar 6 of the well point 1 at a position to be gripped by the upper and lower rotating clamp assemblies 54, 56 which will alternately grip and rotate the well point. Only one clamp assembly rotates the well point at a time. For example, with the well point 1 positioned in the slot 90, co-axially (line C) with the gripping carriage 32, with the well point collar 6 positioned in the slot adjacent the upper clamp assembly 54, the cylinder 82 is actuated to move the movable jaw 80 toward the fixed jaw 79 in a manner to securely grasp the well point collar 6 therebetween. Next, by actuation of the hydraulic cylinder 72, the linear driving member 68 is moved forward, its teeth in engagement with the teeth of the upper gear member 66. The gear member 66 rotates in a counter-clockwise direction upon sleeve 60 while the upper clamp assembly 54 serves to apply torque to the well point 1 gripped by its collar 6 between the jaw members 79, 80. At the same time, the lower clamp assembly 56 has the opposed jaw members 79′, 80′ retracted from engagement with the collar 6 by movement of cylinder 82′, and cylinder 72′ is actuated t o retract linear driving member 68′ in a manner to rotate gear member 66′ in a clockwise direction. When the upper and lower clamp assemblies 54, 56 have completed their respective forward and retracting strokes, cylinder 82′ is actuated to cause the opposed lower jaws 79′, 80′ to engage upon the well point collar 6, and cylinder 82 is actuated to disengage the upper jaws 79, 80 from the collar. Cylinders 72, 72′ are then actuated in their reverse strokes, the lower clamp assembly 56 gripping the well point collar 6 while being rotated in a counter-clockwise direction to apply torque to the well point while the upper clamp assembly 54 is rotated in a clockwise direction to return toward its initial position. Thus the upper and lower rotating gears 66, 66′ cause the respective clamp assemblies 54, 56 to rotate in the same path, but at different levels of the collar of the well point, and at different times. The weight of the gripping carriage 32, plus a suitable downward force applied by the vertical cylinder 50, causes the well point 1 to the move down and drill a half-thread into the ground with each stroke. This operation of biting and rotating will continuing until the well point drill has reached a desired depth in the soil.

As mentioned above, all of the horizontal plates of the apparatus, including the movable plates 76, 76′ and the fixed plates 62, 64, as well as the sleeves 60, 60′ and the gears 66, 66,′ define aligned slots 90, 90′ to permit well points to pass into the location of the fixed jaws and movable jaws.

For removal of a well point 1, the gripping carriage 2 is moved in the reverse of that above description; i.e., the hydraulic cylinder 50 pulls up on the gripping carriage 32 instead of pushing down as in the case of drilling, and the gripping carriage 32 is operated to twist the well point 1 in a manner to break the cohesion between the outer surface of the well point and the soil to facilitate removal of the well point.

Referring again to FIGS. 2 and 3, after a well point 1 has been pulled from the ground G, the fore-boom 20, stub-boom 22 and hydraulic cylinders 26, 28 may be actuated to incline the support column 30 to permit the well point to be laid gently upon the ground, without breakage or damage, the well point being released by way of the slots 90, 90′.

Other embodiments are within the following claims. For example, the movable and fixed jaws (FIGS. 31 through 35) may define a circular or other gripping surface to accommodate other well point shapes.

What is claimed is:

1. A placement and removal apparatus for use in insertion and withdrawal of a well point, said apparatus comprising a vertical support column, a gripping carriage adapted to move vertically along said support column, and means for moving said carriage vertically along said column, said gripping carriage comprising:

a carriage frame;

a first upper clamp assembly and a second, vertically spaced apart lower clamp assembly disposed on said carriage frame, each said clamp assembly adapted to rotate independently about a common vertical axis of rotation; and means for rotating each said clamp assembly independently about said axis of rotation;

each said clamp assembly further comprising opposed jaw elements defining a well point engaging surface and actuating means for causing said well point-engaging surface of said opposed jaw elements to engage about a surface of a well point disposed therebetween;

whereby said gripping carriage is adapted to apply vertical and rotational forces to the well point.

2. The placement and removal apparatus of claim wherein said vertical support column comprises an outer column member and an inner column member disposed coaxially therewithin, said inner column member adapted for movement axially relative to said outer column member.

3. The placement and removal apparatus of claim 2 wherein said vertical support column further comprises means for adjusting the relative axial positions of said outer column member and said inner column member.

4. The placement and removal apparatus of claim 1 wherein said means for rotating each said clamp assembly independently about said axis of rotation comprises means for actuation, a driving element and a rotatable element.

5. The placement and removal apparatus of claim 4 wherein said means for actuation comprises a hydraulic cylinder.

6. The placement and removal apparatus of claim 5 wherein said driving element is connected to said cylinder and is adapted for linear driving motion, and said driving element is disposed in engagement with said rotatable element.

7. The placement and removal apparatus of claim 6 wherein said rotatable element is a gear and said driving element defines a plurality of teeth in engagement with teeth of said gear.

8. The placement and removal apparatus of claim wherein each said clamp assembly is adapted to rotate independently about a common vertical axis of rotation in both a first direction and in a second direction.

9. The placement and removal apparatus of claim wherein said opposed jaw elements comprise a fixed jaw member and a moveable jaw member, and said actuating means is adapted to move said moveable jaw member toward said fixed jaw member.

10. The placement and removal apparatus of claim 1 further comprising a well point having an elongated body with a first lower end and a second upper end, said body defining a central cavity and perforations extending through a wall of said body for flow of water into said cavity, a collar defined adjacent said upper end, and external helical threads defined at least adjacent said lower end.

* * * * *

UNITED STATES PATENT AND TRADEMARK OFFICE

CERTIFICATE OF CORRECTION

PATENT NO. : 5,033,554

DATED : July 23, 1991

INVENTOR(S) : Joseph Younes

It is certified that error appears in the above-identified patent and that said Letters Patent is hereby corrected as shown below:

Col. 2, line 53, "carri" should be --carriage--.

Col. 3, line 19, insert --.-- after "16".

Col. 3, line 51, "i" should be --1--.

Col. 4, line 44, "a synchronously" should be --asynchronously--.

Col. 6, lines 16-17, "t o" should be --to--.

Col. 7, line 23, insert --1-- after "claim".

Col. 8, line 16, insert --1-- after "claim".

Col. 8, line 21, insert --1-- after "claim".

Signed and Sealed this

Sixteenth Day of February, 1993

*Attest:*

STEPHEN G. KUNIN

*Attesting Officer*

*Acting Commissioner of Patents and Trademarks*